US006548233B1

(12) United States Patent
Boettcher et al.

(10) Patent No.: US 6,548,233 B1
(45) Date of Patent: Apr. 15, 2003

(54) THERMALLY DEVELOPABLE EMULSIONS AND IMAGING MATERIALS CONTAINING MIXTURE OF SILVER ION REDUCING AGENTS

(75) Inventors: John W. Boettcher, Webster, NY (US); Paul L. Zengerle, Rochester, NY (US); Roger L. Klaus, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/109,272

(22) Filed: Mar. 28, 2002

(51) Int. Cl.[7] ..... G03C 5/16; G03C 1/498

(52) U.S. Cl. ..... 430/350; 430/523; 430/546; 430/570; 430/603; 430/607; 430/617; 430/619; 430/620; 430/640; 430/944; 430/964; 430/965

(58) Field of Search ..... 430/546, 523, 430/617, 619, 350, 964, 603, 607, 620, 640, 965, 570, 944

(56) References Cited

U.S. PATENT DOCUMENTS

| | | | | |
|---|---|---|---|---|
| 4,430,421 A | | 2/1984 | Van de Sande et al. | |
| 5,434,043 A | | 7/1995 | Zou et al. | |
| 5,605,785 A | * | 2/1997 | Texter et al. | 430/546 |
| 5,677,121 A | | 10/1997 | Tsuzuki | |
| 5,726,003 A | | 3/1998 | Zengerle et al. | |
| 6,140,037 A | | 10/2000 | Katoh et al. | |
| 6,146,823 A | | 11/2000 | Katoh | |

FOREIGN PATENT DOCUMENTS

| | | |
|---|---|---|
| EP | 0 803 765 A1 | 10/1997 |
| EP | 0 848 286 A1 | 6/1998 |
| EP | 0 857 999 B1 | 3/2001 |

* cited by examiner

*Primary Examiner*—Thorl Chea
(74) *Attorney, Agent, or Firm*—J. Lanny Tucker

(57) ABSTRACT

Aqueous-based thermally sensitive emulsions and imaging materials include two or more hindered phenol silver ion reducing agents in a non-crystalline reducing agent composition. Such compositions can be provided as evaporated dispersions and can be formulated in aqueous coating compositions to provide thermally developable materials such as thermographic and photothermographic materials.

31 Claims, No Drawings

THERMALLY DEVELOPABLE EMULSIONS AND IMAGING MATERIALS CONTAINING MIXTURE OF SILVER ION REDUCING AGENTS

FIELD OF THE INVENTION

This invention relates to thermally developable imaging emulsions and materials. In particular, it relates to emulsions for thermographic and photo-thermographic materials that comprise a non-crystalline reducing agent composition containing two or more silver ion reducing agents (developers) required for thermal imaging.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet, or infrared radiation) and developed by the use of thermal energy. These materials, also known as "dry silver" materials, generally comprise a support having coated thereon: (a) a photosensitive catalyst (such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photo-graphic type photosensitive silver halide that is considered to be in catalytic proximity to the non-photosensitive source of reducible silver ions. Catalytic proximity requires intimate physical association of these two components either prior to or during the thermal image development process so that when silver atoms, $(Ag^0)_n$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms [Klosterboer, *Imaging Processes and Materials* (*Neblette's Eighth Edition*), Sturge, Walworth & Shepp (Eds.), Van Nostrand-Reinhold, New York, Chapter 9, pp. 279–291, 1989]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide, have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi*, 1994, 11, 992–997, and FR 2,254,047 (Robillard)].

The photosensitive silver halide may be made "in situ," for example, by mixing an organic or inorganic halide-containing source with a source of reducible silver ions to achieve partial metathesis and thus causing the in situ formation of silver halide (AgX) grains throughout the silver source [see, for example, U.S. Pat. No. 3,457,075 (Morgan et al.)]. In addition, photosensitive silver halides and sources of reducible silver ions can be co-precipitated [see Usanov et al., *J. Imag. Sci. Tech.* 40, 104 (1996)]. Alternatively, a portion of the reducible silver ions can be completely converted to silver halide, and that portion can be added back to the source of reducible silver ions (see Usanov et al., International Conference on Imaging Science, 7–11, September 1998).

The silver halide may also be "preformed" and prepared by an "ex situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to, and be present during, the formation of the source of reducible silver ions. Co-precipitation of the silver halide and the source of reducible silver ions provides a more intimate mixture of the two materials [see for example, U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent for silver ion. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

The various distinctions between photothermographic and photographic materials are described in *Imaging Processes*

*and Materials* (Neblette's Eighth Edition), noted above, *Unconventional Imaging Processes*, E. Brinckman et al. (Eds.), The Focal Press, London and New York, 1978, pp. 74–75, in Zou et al., *J. Imaging Sci. Technol.* 1996, 40, 94–103, and in M. R. V. Sahyun, *J. Imaging Sci. Technol.* 1998, 42, 23.

Problem to be Solved

Most common phototherrnographic materials are prepared using organic solvents for layer formulation and coating, and therefore often identified as "solvent-based" or "non-aqueous" materials. The various chemical components required for such materials are generally soluble in the organic solvents and insoluble in water.

However, photothennographic materials that can be formulated and coated out of water ("aqueous-based" materials) would have a number of manufacturing, environmental, and cost advantages. Use of the same chemical components that are present in solvent-based materials is not always possible in aqueous environments without the use of expensive or tedious solubilizing or dispersing techniques. The water-insoluble chemical components tend to precipitate and cause variability in photosensitive response and coating defects when used in aqueous formulations even with adequate dispersion.

Aqueous-based photothermographic materials require specific components to provide optimal coating, imaging, and development. In addition, those components need to be formulated in specific ways to achieve uniform dispersion throughout the imaging layers. For example, it is common to mechanically disperse crystalline silver ion reducing agents (developers) as ball-milled solid particles. This procedure is described for example in U.S. Pat. No. 6,140,037 (Katoh et al.) and U.S. Pat. No. 6,146,823 (Katoh). One problem encountered with solid particle reducing agents is that they may exhibit lowered reactivity.

Most hindered phenols used as reducing agents in thermally developable materials (including thermographic and photothermographic materials) have a crystalline nature. Attempts to disperse them in aqueous formulations resulted in plugging of coating apparatus during manufacture, various physical defects, and imaging non-uniformities.

Hence, there is a need for improved aqueous-based (hydrophilic) thermally developable formulations and materials that include conventional silver ion reducing agents.

SUMMARY OF THE INVENTION

The present invention provides a thermally sensitive emulsion comprising:

a) a non-photosensitive source of reducible silver ions, b) a hydrophilic binder, and c) a non-crystalline reducing agent composition for the reducible silver ions, which non-crystalline reducing agent composition includes two or more hindered phenol silver ion reducing agents.

Photothermographic emulsions of this invention include the same components a) through c) noted above as well as a photosensitive silver halide.

In addition, this invention provides a thermally developable material comprising a support having thereon at least one imaging layer comprising a hydrophilic binder, and having in reactive association:

a) a non-photosensitive source of reducible silver ions, and b) a non-crystalline reducing agent composition for the reducible silver ions, which non-crystalline reducing agent composition includes two or more hindered phenol silver ion reducing agents.

Thermographic materials of the present invention can be readily imaged by application of thermal energy in an imagewise fashion.

Further, a photothermographic material comprises a support having thereon at least one imaging layer comprising a hydrophilic binder, and having in reactive association:

a) a photosensitive silver halide, b) a non-photosensitive source of reducible silver ions, and c) a non-crystalline reducing agent composition for the reducible silver ions, which non-crystalline reducing agent composition includes two or more hindered phenol silver ion reducing agents.

In preferred embodiments, a photothermographic material comprises a transparent support having thereon an aqueous-based imaging layer comprising gelatin or a gelatin derivative as binder, and having in reactive association:

a) photosensitive silver bromide, silver iodobromide, or both, b) a non-photosensitive source of reducible silver ions that comprises one or more silver carboxylates provided as an aqueous nanoparticulate dispersion, at least one of which silver carboxylates is silver behenate, c) a non-crystalline reducing agent composition for the reducible silver ions that includes a mixture of 2,2'-(2-methylpropylidene)bis(4,6-dimethyl-phenol) (DEV-1) and 2,2'-(3,5,5-trimethylhexylidene)bis(4,6-dimethyl-phenol) (DEV-2), which mixture is provided as an evaporated dispersion, and d) one or more antifoggants, toners, or spectral sensitizing dyes, the photothermographic material further comprising an aqueous-based surface protective overcoat over the imaging layer, and an aqueous-based antihalation layer on the backside of the support.

A method of making a photothermographic emulsion comprises the steps of:

A) dissolving two or more crystalline hindered phenol silver ion reducing agents in one or more low boiling organic solvents to form a solvent solution, with or without one or more permanent, high-boiling organic solvents, B) combining the solvent solution with a hydrophilic binder and a surfactant to form a two-phase mixture, C) emulsifying the two-phase mixture, D) removing the one or more low boiling organic solvents to provide a non-crystalline reducing agent composition, and E) combining the non-crystalline reducing agent composition with a photosensitive silver halide and a non-photosensitive source of reducible silver ions.

A method of forming a visible image comprises:

A) imagewise exposing the photothermographic material described above to electromagnetic radiation at a wavelength greater than 400 nm to form a latent image, B) simultaneously or sequentially, heating the exposed photothermo-graphic material to develop the latent image into a visible image.

In some embodiments of this imaging method, the photothermo-graphic material comprises a transparent support, and the image-forming method further comprising:

C) positioning the exposed and heat-developed photothermographic material having the visible image therein between a source of imaging radiation and an imageable material that is sensitive to the imaging radiation, and D) thereafter exposing the imageable material to the imaging radiation through the visible image in the exposed and heat-developed photothermographic material to provide a visible image in the imageable material.

We have discovered that the thermally developable emulsions and materials of the present invention can be prepared with hydrophilic binders (that is, aqueous systems) using hindered phenol silver ion reducing agents that are provided in non-crystalline (amorphous) form during and after formulation.

While the reducing agents are normally crystalline, they can be transformed into a non-crystalline form that makes them readily dispersible and stable in aqueous formulations, thereby avoiding the problems associated with dispersing crystalline chemicals into aqueous formulations.

These advantages are achieved by using a mixture of two or more hindered phenol silver ion reducing agents that are in non-crystalline (amorphous) form instead of crystalline form. As described in more detail below, preferably, the non-crystalline reducing agent compositions used in the practice of this invention are provided as "evaporated dispersions".

DETAILED DESCRIPTION OF THE INVENTION

The thermally developable emulsions and materials of this invention can be used, for example, in conventional black-and-white or color thermography or photothermography, in electronically generated black-and-white or color hardcopy recording. They can be used in microfilm applications, in radiographic imaging (for example digital medical imaging), and industrial radiography. They can also be used in the graphic arts area (for example, image-setting and phototypesetting), in the manufacture of printing plates, and in proofing. Furthermore, the absorbance of these photothermographic materials between 350 and 450 nm is sufficiently low (less than 0.5) to permit their use in graphic arts applications such as contact printing, proofing, and duplicating ("duping"). The thermographic and photothermographic materials of the present invention are particularly useful for medical radiography to obtain black-and-white images.

In the thermally developable materials of this invention, the components for imaging can be in one or more layers. The layer(s) that contain a photosensitive silver halide (in the case of photothermographic materials) and non-photosensitive source of reducible silver ions, or both, are referred to herein as emulsion layer(s). The photosensitive silver halide and the non-photosensitive source of reducible silver ions are in catalytic proximity and preferably in the same emulsion layer. In addition, the non-photosensitive source of reducible silver ions and the non-crystalline reducing agent are in catalytic proximity and preferably in the same emulsion layer.

Various layers can be disposed on the "backside" (non-emulsion or non-imaging side) of the materials, including antihalation layer(s), protective layers, antistatic layers, conducting layers, and transport enabling layers.

Various layers are also usually disposed on the "frontside", imaging, or emulsion side of the support, including protective topcoat layers, primer layers, interlayers, opacifying layers, antistatic layers, antihalation layers, acutance layers, auxiliary layers, and others readily apparent to one skilled in the art.

In thermography, imaging is carried out by imagewise heating the thermographic materials of the present invention using any suitable source of imaging thermal energy (such as a laser).

For photothermography, the process for the formation of a visible image (usually a black-and-white image) comprises first exposing to suitable electromagnetic radiation and thereafter heating the photothermographic material.

This visible image can also be used as a mask for exposure of other photosensitive imageable materials, such as graphic arts films, proofing films, printing plates and circuit board films, that are sensitive to suitable imaging radiation (for example UV radiation). This can be done by imaging an imageable material (such as a photopolymer, a diazo material, a photoresist, or a photosensitive printing plate) through the exposed and heat-developed photothermographic material using steps C) and D) noted above.

When the photothermographic materials are heat-developed as described below in a substantially water-free condition after, or simultaneously with, imagewise exposure, a silver image (preferably a black-and-white silver image) is obtained. The photothermographic material may be exposed in step A using ultraviolet, visible, infrared or laser radiation using an infrared laser, a laser diode, an infrared laser diode, a light-emitting screen, a CRT tube, a light-emitting diode, or other light or radiation source readily apparent to one skilled in the art.

Definitions

As used herein:

In the descriptions of the thermally developable materials of the present invention, "a" or "an" component refers to "at least one" of that component.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Macmillan 1977, p. 374.

"Photothermographic material(s)" means a construction comprising at least one photothermographic emulsion layer or a photothermographic set of layers (wherein the photosensitive silver halide and the non-photosensitive source of reducible silver ions are in one layer and the other components or additives are distributed, as desired, in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. "Thermographic material(s)" are similarly defined except they do not include a photosensitive silver halide (or other photosensitive component) for imaging.

"Thermally-sensitive" emulsions refer to both "photothermographic emulsions" as well as "thermographic emulsions" (that are useful for thermography and therefore lack the photosensitive component).

"Photothermographic emulsion" or "emulsion" refers to a dispersion that comprises as essential components: at least one photosensitive silver halide and at least one non-photosensitive source of reducible silver ions. As is well known in the art, the emulsion can include many other components (including the non-crystalline reducing agent compositions described below) and other addenda that described in more detail below. These layers are usually on what is known as the "frontside" of the support.

"Non-photosensitive" means not intentionally light sensitive.

The sensitometric terms "photospeed" or "photographic speed" (also known as "sensitivity"), "contrast", $D_{min}$, and $D_{max}$ have conventional definitions known in the imaging arts.

"Transparent" means capable of transmitting visible light or imaging radiation without appreciable scattering or absorption.

"Hydrophilic" means that the compound so defined is compatible (soluble or readily dispersible in) an aqueous solvent that includes at least 50 volume % water.

As is well understood in this art, for the various essential compounds described herein, substitution is not only tolerated, but is often advisable and various substituents are anticipated on the compounds used in the present invention. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy and the like. For example, alkyl group includes ether and thioether groups (for example $CH_3$—$CH_2$—$CH_2$—O—$CH_2$—or $CH_3$—$CH_2$—$CH_2$—S—$CH_2$—), haloalkyl, nitroalkyl, carboxyalkyl, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred, with the latter silver halide having up to 10 mol % silver iodide. Typical techniques for preparing and precipitating silver halide grains are described in *Research Disclosure*, 1978, Item 17643.

The shape of the photosensitive silver halide grains used in the present invention is in no way limited. The silver halide grains may have any crystalline habit including, but not limited to, cubic, octahedral, rhombic, dodecahedral, orthorhombic, tetrahedral, other polyhedral, laminar, twinned, platelet, or tabular morphologies and may have epitaxial growth of crystals thereon. If desired, a mixture of these crystals can be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. Core-shell silver halide grains useful in photothermographic materials and methods of preparing these materials are described for example in U.S. Pat. No. 5,382,504 (Shor et al.) incorporated herein by reference. Iridium and/or copper doped core-shell and non-core-shell grains are described in U.S. Pat. No. 5,434,043 (Zou et al.) and U.S. Pat. No. 5,939,249 (Zou), incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions. It is more preferable to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps."

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 $\mu$m.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Chapter 2, Macmillan Company, 1966. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)].

It is also effective to use an in situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

In some instances, it may be helpful to prepare the photosensitive silver halide grains in the presence of a hydroxytetraazindene (such as 4-hydroxy-6-methyl-1,3,3a, 7-tetraazaindene) or an N-heterocyclic compound comprising at least one mercapto compound (such as 1-phenyl-5-mercaptotetrazole) to provide increased photospeed. Details of this procedure are provided in copending and commonly assigned U.S. Ser. No. 09/833,533 (filed Apr. 12, 2001 by Shor, Zou, Ulrich, and Simpson) that is incorporated herein by reference.

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), and JP Applications 13224/74, 42529/76, and 17216/75.

Preferably, the photosensitive silver halide(s) used in the practice of this invention are provided as a hydrophilic photosensitive silver halide emulsion comprising one or more hydrophilic binders and/or peptizers. Most likely the photosensitive silver halide emulsion includes one or more conventional peptizers that are well known to one skilled in the art, including but not limited to, gelatino peptizers such as phthalated gelatin, non-phthalated gelatin, and acid or base hydrolyzed gelatins. The amount of peptizer in this emulsion will dependent upon such factors as the particular photosensitive silver halide, the desired image, the particular components of the photothermographic emulsion, and coating conditions. In some embodiments, the peptizer(s) is present in an amount of from about 5 to about 40 g per mole of silver from the silver halide. Useful procedures for preparing such photosensitive silver halide emulsions are described for example in Product Licensing Index, Vol., 92, Item 9232, December 1971 (now know as *Research Disclosure*).

The one or more light-sensitive, silver halides used in the photo-thermographic materials of the present invention are preferably present in an emulsion (imaging) layer in an amount of from about 0.005 to about 0.5 mole, more preferably from about 0.01 to about 0.25 mole per mole, and most preferably from about 0.03 to about 0.15 mole, per mole of non-photosensitive source of reducible silver ions.

Chemical and Spectral Sensitizers

The photosensitive silver halides used in the invention may be employed without modification. However, they are preferably chemically and/or spectrally sensitized in a manner similar to that used to sensitize conventional wet-processed silver halide photographic materials or state-of-the-art heat-developable photothermographic materials.

Thus, the photothermographic material may be chemically sensitized with one or more chemical sensitizing agents, such as a compound containing sulfur, selenium, or tellurium, or with a compound containing gold, platinum, palladium, ruthenium, rhodium, iridium, or combinations thereof, a reducing agent such as a tin halide or a combination of any of these. The details of these procedures are described in T. H. James, *The Theory of the Photographic Process*, Fourth Edition, Chapter 5, pp. 149 –169. Suitable chemical sensitization procedures are also disclosed in U.S. Pat. No. 1,623,499 (Sheppard et al.), U.S. Pat. No. 2,399,083 (Waller et al.), U.S. Pat. No. 3,297,447 (McVeigh), and U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP-A-0 915 371 (Lok et al.).

One method of chemical sensitization is by oxidative decomposition of a spectral sensitizing dye in the presence of a photothermo-graphic emulsion, as described in U.S. Pat. No. 5,891,615 (Winslow et al.), incorporated herein by reference.

Sulfur-containing chemical sensitizers useful in the present invention are well known in the art and described for example, in Sheppard et al., *J. Franklin Inst.*, 1923, 196, pp. 653 and 673, C. E. K. Mees and T. H. James, *The Theory of the Photographic Process*, 4$^{th}$ Edition, 1977, pp. 152–3, Tani, T., *Photographic Sensitivity: Theory and Mechanisms*, Oxford University Press, NY, 1995, pp. 167–176, U.S. Pat. No. 5,891,615 (Winslow et al.), Zavlin et al., IS&T's 48$^{th}$ Annual Conference Papers, May 7–11 1995 Washington D.C., pp. 156–6), U.S. Pat. No. 4,810,626 (Burgmaier et al.), U.S. Pat. No. 4,036,650 (Kobayashi et al.), U.S. Pat. No. 4,213,784 (Ikenoue et al.), and U.S. Pat. No. 4,207,108 (Hiller).

Particularly useful sulfur-containing chemical sensitizers are tetrasubstituted thiourea compounds, preferably such thiourea compounds that are substituted with the same or different aliphatic substituents, and more preferably such thiourea compounds that are substituted with the same aliphatic substituent. Such useful thioureas are described for example in U.S. Pat. No. 5,843,632 (Eshelman et al.) and in copending and commonly assigned U.S. Ser. No. 09/667, 748 (filed Sep. 21, 2000 by Lynch, Simpson, Shor, Willett, and Zou), incorporated herein by reference.

Particularly, useful tellurium-containing chemical sensitizing compounds are described in copending and commonly assigned U.S. Ser. No. 09/975,909 (filed Oct. 11, 2001 by Lynch, Opatz, Shor, Simpson, Willett, and Gysling), incorporated herein by reference.

Useful combinations of sulfur- or tellurium-containing chemical sensitizers with gold(III)-containing chemical sensitizers are described in copending and commonly assigned U.S. Ser. No. 09/768,094 (filed Jan. 23, 2001 by Simpson, Whitcomb, and Shor), incorporated herein by reference.

The total amount of chemical sensitizers that may be used during formulation of the photographic imaging composition will generally vary depending upon the average size of silver halide grains. The total amount is generally at least $10^{-10}$ mole per mole of total silver, and preferably from $10^{-8}$ to about $10^{-2}$ mole per mole of total silver for silver halide grains having an average size of from about 0.01 to about 2 $\mu$m. The upper limit can vary depending upon the compound used, the level of silver halide and the average grain size, and it would be readily determinable by one of ordinary would be readily determinable by one of ordinary skill in the art.

In general, it may also be desirable to add spectral sensitizing dyes to enhance silver halide sensitivity to ultraviolet, visible and infrared light. Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. The cyanine dyes, merocyanine dyes and complex merocyanine dyes are particularly useful. Suitable sensitizing dyes such as those described in U.S. Pat. No. 3,719,495 (Lea), U.S. Pat. No. 5,393,654 (Burrows et al.), U.S. Pat. No. 5,441,866 (Miller et al.) and U.S. Pat. No. 5,541,054 (Miller et al.), U.S. Pat. No. 5,281,515 (Delprato et al.), and U.S. Pat. No. 5,314,795 (Helland et al.) are effective in the practice of the invention. All of the patents above are incorporated herein by reference.

An appropriate amount of spectral sensitizing dye added is generally about $10^{-10}$ to $10^{-1}$ mole, and preferably, about $10^{-7}$ to $10^{-2}$ mole per mole of silver halide.

To further control the properties of photothermographic materials, (for example, contrast, $D_{min}$, speed, or fog), it may be preferable to add one or more heteroaromatic mercapto compounds or heteroaromatic disulfide compounds as "supersensitizers". Examples include compounds of the formulae: Ar—S—M and Ar—S—S—Ar, wherein M represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. Many of the above compounds are described in EP-A-0 559 228 (Philip Jr. et al.) as supersensitizers.

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenz-imidazole, 2-mercapto-5-methylbenzimidazole, 2-mercaptobenzothiazole and 2-mercaptobenzoxazole, and mixtures thereof If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

Non-Photosensitive Reducible Silver Source Material

The non-photosensitive source of reducible silver ions used in thermographic and photothermographic materials of the present invention can be any material that contains reducible silver ions. Preferably, it is a silver salt that is comparatively stable to light and forms a silver image when heated to 80° C. or higher in the presence of an exposed photosensitive silver halide and/or a reducing agent.

Silver salts of organic acids, particularly silver salts of long-chain carboxylic (fatty) acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. It is particularly useful to have at least silver behenate.

Preferred examples of the silver salts of aromatic carboxylic acid and other carboxylic acid group-containing compounds include, but are not limited to, silver benzoates, a silver substituted-benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellitate, a silver salt of 3-carboxymethyl-4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates comprising hydrocarbon chains incorporating ether or thioether linkages, or sterically hindered substitution in the α-(on a hydrocarbon group) or ortho-(on an aromatic group) position, and displaying increased solubility in coating solvents and providing coatings with less light scattering can also be used. Such silver carboxylates are described in U.S. Pat. No. 5,491,059 (noted above). Mixtures of any of the silver salts described herein can also be used if desired.

Silver salts of sulfonates are also useful in the practice of this invention. Such materials are described for example in U.S. Pat. No. 4,504,575 (Lee). Silver salts of sulfosuccinates are also useful as described for example in EP-A-0 227 141 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-amino-thiadiazole, a silver salt of 2-(2-ethylglycolamido)benzothiazole, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,201,678 (Meixell)].

Furthermore, a silver salt of a compound containing an imino group can be used. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used as described, for example in U.S. Pat. No. 4,761,361 (Ozaki et al.) and U.S. Pat. No. 4,775,613 (Hirai et al.).

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial fatty carboxylic acid, or by addition of the free fatty acid to the silver soap. For transparent films a silver carboxylate full soap, containing not more than about 15% of free carboxylic acid and analyzing for about 22% silver, can be used. For opaque photothermographic materials, different amounts can be used.

Another useful source of non-photosensitive reducible silver ions in the practice of this invention are the silver dimer compounds that comprise two different silver salts as described in copending U.S. Ser. No. 09/812,597 filed Mar. 20, 2001 by Whitcomb. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

In addition, the non-photosensitive silver compounds can be prepared as mixtures of non-photosensitive silver compounds. One such mixture can be prepared by the sequential formation of a second non-photosensitive silver compound in the presence of a previously prepared non-photosensitive silver compound. Such compounds have been referred to as "core-shell" silver salts. The preparation of such compositions would be readily apparent from the teaching provided herein as well as that provided in U.S. Pat. No. 6,355,408B1 (Whitcomb et al.).

The methods used for making silver soap dispersions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

It is particularly preferred that the non-photosensitive source of reducible silver ions be provided in the form of an aqueous nanoparticulate dispersion of silver salt particles (such as silver carboxylate particles). The silver salt particles in such dispersions generally have a weight average particle size of less than 1000 nm when measured by any useful technique such as sedimentation field flow fractionation, photon correlation spectroscopy, or disk centrifugation. Obtaining such small silver salt particles can be achieved using a variety of techniques that are described in the copending applications identified in the following paragraphs, but generally they are achieved using high speed milling using a device such as those manufactured by Morehouse-Cowles and Hochmeyer. The details for such milling are well known in the art.

Such dispersions also advantageously include a surface modifier so the silver salt can more readily be incorporated into aqueous-based photothermographic formulations. Useful surface modifiers include, but are not limited to, vinyl polymers having an amino moiety, such as polymers prepared from acrylamide, methacrylamide, or derivatives thereof, as described in copending and commonly assigned U.S. Ser. No. 09/764,677 filed Jan. 18, 2001 by Lelental, Pill, Dickinson, Wakley, and Ghyzel as a CIP of U.S. Ser. No. 09/502,125 filed Feb. 10, 2000, now abandoned, both incorporated herein by reference. A particularly useful surface modifier is dodecylthiopolyacrylamide that can be prepared as described in the noted copending application using the teaching provided by Pavia et al., *Makromolecular Chemie*, 193(9), 1992, pp. 2505–17.

Other useful surface modifiers are phosphoric acid esters, such as mixtures of mono-and diesters of orthophosphoric acid and hydroxy-terminated, oxyethylated long-chain alcohols or oxyethylated alkyl phenols as described for example in U.S. Ser. No. 09/764,665 filed Jan. 18, 2001 by Lelental, Dickinson, and Wakley as a CIP of U.S. Ser. No. 09/501,815 filed Feb. 10, 2000, now abandoned, both incorporated herein by reference. Particularly useful phosphoric acid esters are commercially available from several manufacturers under the trademarks or tradenames EMPHOS™ (Witco Corp.), RHODAFAC (Rhone-Poulenc), T-MULZ® (Hacros Organics), and TRYFAC (Henkel Corp./Emery Group).

Such dispersions contain smaller particles and narrower particle size distributions than dispersions that lack such surface modifiers. Particularly useful nanoparticulate dispersions are those comprising silver carboxylates such as silver salts of long chain fatty acids having from 8 to 30 carbon atoms, including, but not limited to, silver behenate, silver caprate, silver hydroxystearate, silver myristate, silver palmitate, and mixtures thereof Silver behenate nanoparticulate dispersions are most preferred. These nanoparticulate dispersions can be used in combination with the conventional silver salts described above, including but not limited to, silver benzotriazole, silver imidazole, and silver benzoate.

The one or more non-photosensitive sources of reducible silver ions are preferably present in an amount of about 5% by weight to about 70% by weight, and more preferably, about 10% to about 50% by weight, based on the total dry weight of the emulsion layer. Stated another way, the amount of the sources of reducible silver ions is generally present in an amount of from about 0.001 to about 0.2 mol/$m^2$ of the dry photothermographic material, and preferably from about 0.01 to about 0.05 mol/$m^2$ of that material.

The total amount of silver (from all silver sources) in the photo-thermographic materials is generally at least 0.002 mol/$m^2$ and preferably from about 0.01 to about 0.05 mol/$m^2$.

Reducing Agents

Most hindered phenols used as reducing agents in thermally developable materials are naturally crystalline materials, and when incorporated as solid-particle dispersions, they retain their crystalline nature. The hindered phenols used in the practice of the present invention are similarly crystalline, but the inventive process produces a mixture that is non-crystalline or amorphous. Thus, the reducing agent composition used in the present invention is non-crystalline and comprises two or more originally crystalline hindered phenols.

By "non-crystalline", we mean that the reducing agent composition exhibits no birefringence when examined by optical microscopy using polarized light.

The hindered phenol reducing agents used in the practice of this invention contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), bisphenols (that is dihydroxybiphenyls), bis(hydroxynaphthyl)methanes, bis (hydroxy-phenyl)methanes, and hindered naphthols each of which may be variously substituted, many of which are described in U.S. Pat. No. 3,094,417 (Workman) and U.S. Pat. No. 5,262,295 (Tanaka et al.), both incorporated herein by reference.

Particularly useful mixtures of hindered phenols are mixtures of bisphenols. One particularly useful mixture includes 2,2'-(2-methylpropylidene)bis(4,6-dimethylphenol) (DEV-1) and 2,2'-(3,5,5-trimethylhexylidene)bis(4,6-dimethylphenol) (DEV-2).

While the non-crystalline form of hindered phenols can be obtained in any conventional manner, in preferred embodiments, they are provided in what are known as "evaporated dispersions" that have reduced the likelihood of crystallization during and after coating. Such dispersions are prepared by dissolving two or more crystalline hindered phenol silver ion reducing agents in one or more "low boiling" organic solvents to provide a solvent solution. By "low boiling" organic solvents is meant solvents that have a boiling point less than 150° C. under atmospheric pressure. Examples of such solvents include, but are not limited to, lower alkyl acetates (such as methyl acetate, ethyl acetate, n-propyl acetate, isopropyl acetate, and butyl acetates), lower alkyl propionates (such as methyl propionate and ethyl propionate), chlorinated hydrocarbons (such as carbon tetrachloride, sym-dichloroethylene, trichloroethylene, 1,2-dichloropropane, and chloroform), amyl chloride, diethyl carbonate, ketones (such as diethyl ketone, methyl ethyl ketone, methyl-n-propylketone, and diethyl ketone), diisopropyl ether, cyclohexane, methylcyclohexane, ligroin, benzene, toluene, xylene, nitromethane, and other water-immiscible organic solvents that would be readily apparent to one skilled in the art.

Low boiling water-miscible organic solvents can also be used. These include, but are not limited to, alcohols (such as methanol, ethanol, and isopropanol), dimethylsulfoxide, tetrahydrofuran, N-methyl-pyrrolidone, dioxane, acetone, butyrolactone, ethylene glycol, ethylene glycol monomethyl ether, ethylene glycol monoethyl ether, ethylene glycol monobutyl ether, glycerol, acetonitrile, formamide, N,N-dimethylformamide, tetrahydrothiophene dioxide, and dimethoxyethane. Other useful solvents are described in U.S. Pat. No. 4,430,421 (Van de Sande et al.) and references cited therein. Ethyl acetate is the most preferred low boiling organic solvent. Generally, up to 50 weight % of the crystalline hindered phenols is dissolved in the one or more low boiling solvents at the beginning of this process.

The hindered phenols described herein can be dissolved within the one or more low boiling organic solvents at any suitable temperature from room temperature up to the boiling point of the low boiling organic solvents.

The non-crystalline reducing agent composition may also include one or more "permanent" high boiling organic solvents as long as they comprise less than 50 volume % of the total composition solvent volume. Preferably, the compositions of this invention comprise less than 10 volume % of such "permanent" high boiling organic solvents and more preferably, they include no permanent" high boiling organic solvents. Such solvents generally have a boiling point greater than 150° C. and are also known in the art as "oil-formers" as described for example in U.S. Pat. No. 4,430,421 (noted above). This patent is incorporated herein by reference for its listing (Col. 9) of representative "oil-formers" or "permanent" organic solvents.

The resulting solvent solution is combined or mixed with one or more hydrophilic binders and one or more surfactants (usually in an aqueous solution or phase) to form a two-phase mixture. Suitable hydrophilic binders are described below but gelatin, gelatin derivatives, hydroxy-substituted cellulosic materials, and poly(vinyl alcohol) are preferred. The hydrophilic binders are generally present in the aqueous phase in an amount of from about 1 to about 20 weight %, and preferably about 4 to about 12 weight %.

A surfactant is usually present in the aqueous phase in an amount of at least 0.1 weight % and preferably from about 0.2 to about 2 weight %. Any suitable anionic, nonionic, cationic, or amphoteric surfactant can be used. Preferably, useful surfactants are anionic in nature and include, but are not limited to, alkali metal salts of an alkarylene sulfonic acid such as the sodium salt of dodecyl benzene sulfonic acid or sodium salts of isopropylnaphthalene sulfonic acids, such as mixtures of di-isopropyl-and triisopropylnaphthalene sodium sulfonates; an alkali metal salt of an alkyl sulfuric acid, such as sodium dodecyl sulfate, or an alkali metal salt of an alkyl sulfosuccinate, such as sodium bis(2-ethylhexyl) succinic sulfonate.

The resulting two-phase mixture is then emulsified or mixed in a suitable fashion, which generally means mixing in a suitable mechanical device that provides high shear or turbulent mixing. Such devices include, but are not limited to, colloid mills, homogenizers, microfluidizers, high-speed mixers, high speed mixers, ultrasonic dispersing apparatus, blade mixers, Gaulin mills, blenders, and other devices known in the art for this purpose. More than one type of device can be used for emulsification. The resulting two-phase mixture comprises small droplets of the organic phase suspended in the aqueous phase. The dispersion droplets generally have an average particle size of less than 10 $\mu$m, and preferably of from about 0.05 to about 3 $\mu$m.

The low boiling organic solvent(s) can be removed from the two-phase mixture using any suitable method including evaporation, noodle washing, and membrane dialysis, all of which are conventional procedures. Preferably, low boiling organic solvent removal is achieved by evaporation.

Once the low boiling organic solvents are removed, the resulting non-crystalline reducing agent composition comprising the two or more originally crystalline hindered phenols is generally mixed with the other components of a thermally sensitive emulsions or formulation including one or more non-photosensitive sources of reducible silver ions, and in the case of photothermographic emulsions, one or more photosensitive silver halides, in any suitable order. Alternatively, the reducing composition can be coated as a separate layer in the thermally developable materials.

In some instances, the non-crystalline reducing agent composition also includes a contrast enhancing agent. Examples of useful contrast enhancing agents include, but are not limited to, hydroxylamines (including hydroxylamine and alkyl-and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the above patents are incorporated herein by reference.

The non-crystalline hindered phenol reducing agent composition of this invention is generally present in an amount of from about 5 to about 30% (dry weight) of an emulsion layer. In multilayer constructions, if the reducing agents are added to a layer other than an emulsion layer, slightly higher amounts may be used. Any contrast enhancing agents are present in conventional amounts.

Other Addenda

The phototherrnographic materials of this invention preferably include one or more water-soluble or water-dispersible antifoggants that have a pKa of 8 or less. In addition, they are represented by the following Structure I:

$$R_1—SO_2—C(R_2)R_3—(CO)_m—(L)_n—SG$$

wherein $R_1$ is a substituted or unsubstituted aliphatic or cyclic group of any size as long as the antifoggant remains soluble or readily dispersible in water. Substituted or unsubstituted aliphatic groups for $R_1$ include monovalent groups having 1 to 20 carbon, nitrogen, sulfur, and oxygen atoms in the chain including, but not limited to, chains that include one or more substituted or unsubstituted alkyl groups (having 1 to 10 carbon atoms), substituted or unsubstituted alkenylene groups (having 2 to 20 carbon atoms), substituted or unsubstituted alkylenearylene groups (having 7 to 20 carbon atoms in the chain), and combinations of any of these groups, as well as combinations of these groups that are connected with one or more amino, amido, carbonyl, sulfonyl, carbonamido, sulfonamido, thio, oxy, oxycarbonyl, oxysulfonyl, and other connecting groups that would be readily apparent to one skilled in the art. The various types of useful aliphatic groups would be readily apparent to one skilled in the art.

Preferred aliphatic groups for $R_1$ include substituted or unsubstituted t-butyl and trifluoromethyl groups.

$R_1$ can also be substituted or unsubstituted cyclic groups including substituted or unsubstituted carbocyclic aryl groups (having 6 to 14 carbon atoms to form the cyclic ring), substituted or unsubstituted cycloalkylene groups (having 5 to 10 carbon atoms to form the cyclic ring) and heterocyclic groups (having 5 to 10 carbon, nitrogen, sulfur, or oxygen atoms to form the cyclic ring), both aromatic and nonaromatic. The various types of cyclic groups would be readily apparent to one skilled in the art.

Preferred cyclic groups for $R_1$ include substituted or unsubstituted aryl groups having 6 to 10 carbon atoms to form the cyclic ring. Substituted or unsubstituted phenyl groups are most preferred. Methyl groups are preferred substituents on the phenyl group.

More preferably, $R_1$ is 4-methylphenyl, phenyl, trifluoromethyl, adamantyl, or tertiary butyl.

In Structure I, $R_2$ and $R_3$ are independently hydrogen or bromine as long as one of them is bromine. Preferably, both $R_2$ and $R_3$ are bromine.

In addition, L is a substituted or unsubstituted aliphatic divalent linking group that can have the same definition as $R_1$ except that L is divalent. Thus, one skilled in the art would be able to determine suitable L groups that would serve the desired purpose while maintaining compound water solubility or dispersibility. Preferably, L is an —NH—alkylene group wherein "alkylene" is substituted or unsubstituted and has 1 to 10 carbon atoms (more preferably 1 to 3 carbon atoms).

When m and n are each 1, L is preferably an —N($CH_3$)—alkylene—or —NH—alkylene-group.

Substituents on $R_1$ and L can be any chemical moiety that would not adversely affect the desired function of the antifoggant and can include, but are not limited to, alkyl, aryl, heterocyclic, cycloalkyl, amino, carboxy, hydroxy, phospho, sulfonamido, sulfo, and other groups that would be readily apparent to one skilled in the art. The number of substituents is limited only by the number of available valences (available hydrogen atoms). Alkyl groups are preferred substituents for cyclic $R_1$ groups. However, as would be apparent, the antifoggants can have multiple sulfo, carboxy, phospho, and sulfonamido groups that impart water solubility to the molecule.

Further, in Structure I, m and n are independently 0 or 1, and preferably, both are 1.

SG can be any solubilizing group having a pKa of 8 or less that does not interfere with its antifogging activity. SG may be in the free acid form or it may be a salt, particularly a suitable metal salt (for example, an alkali metal salt) or ammonium ion salt. Preferably, SG is a salt. When SG is in its free acid form, the salt can be generated in situ by neutralization with any basic material commonly used by one skilled in the art. Preferably, SG is a carboxy, phospho, sulfo, or sulfonamido group. When SG is a sulfonamido group, it may be —$SO_2N^-COR_4M^+$, or —$NSO_2R_4M^+$ wherein $R_4$ is a substituted or unsubstituted aliphatic or cyclic group as defined from $R_1$. $R_1$ and $R_4$ can be the same or different group. More preferably, SG is a carboxy or sulfo group (or salts thereof), particularly when both m and n are 1.

$M^+$ is a suitable cation such as hydrogen or a metal cation (preferably an alkali metal cation) or an ammonium ion. When $M^+$ is a hydrogen atom, the resulting free acid can be easily solubilized by neutralization with a suitable base such as for example, potassium hydroxide or sodium bicarbonate.

In preferred embodiments, when m and n are both 0, SG is carboxy (or a salt thereof), sulfo (or a salt thereof), phospho (or a salt thereof), —$SO_2N^-COR_4M^+$, or —$NSO_2R_4M^+$ wherein $M^+$ is as defined above.

Additionally, when m and n are both 1, SG is carboxy (or a salt thereof), sulfo (or a salt thereof), phospho (or a salt thereof), or —$SO_2N^-COR_4M^+$ wherein $M^+$ is as defined above.

Moreover, when m is 1 and n is 0, SG is carboxy (or a salt thereof), sulfo (or a salt thereof), phospho (or a salt thereof), or —$N^-SO_2R_4M^+$ wherein $M^+$ is as defined above.

Further details about these preferred antifoggants are provided in copending U.S. Ser. No. 10/014,961 filed Dec. 11, 2001 by Burgmaier and Klaus.

The antifoggants can be used individually or in combination in the photothermographic materials of this invention. Generally, they are present in an amount of at least 0.0001 mol/mol of total silver. Preferably, they are present in an amount of from about 0.001 to about 0.1 mol/mol of total silver.

Preferably, the antifoggants are included in the one or more photothermographic emulsion layers, but during manufacture, they can also be incorporated into interlayers, underlayers, and protective topcoat layers on the frontside of the support. If they are placed in a non-emulsion layer, they tend to migrate into the emulsion layer(s) where they become effective in reducing $D_{min}$.

The thermographic and photothermographic materials of the present invention can also contain other additives, where appropriate, such as shelf-life stabilizers, toners, additional antifoggants besides those described above, contrast enhancers, development accelerators, acutance dyes, post-processing stabilizers or stabilizer precursors, and other image-modifying agents as would be readily apparent to one skilled in the art.

The materials can be further protected against the production of fog and can be stabilized against loss of sensitivity during storage. It may be advantageous to add mercury (II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable optional antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum and gold salts as described in U.S. Pat. No. 2,566,263 (Trirelli) and U.S. Pat. No. 2,597,915 (Damshroder), and 2-(tribromomethylsulfonyl) quinoline compounds as described in U.S. Pat. No. 5,460,938 (Kirk et al.). Stabilizer precursor compounds capable of releasing stabilizers upon application of heat-during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzo-triazoles) have been found to be useful stabilizing compounds (such as for post-processing print stabilizing), as described in U.S. Pat. No. 6,171,767 (Kong et al.).

Furthermore, other specific useful antifoggants/stabilizers are described in more detail in U.S. Pat. No. 6,083,681 (Lynch et al.), incorporated herein by reference.

Other optional antifoggants are hydrobromic acid salts of heterocyclic compounds (such as pyridinium hydrobromide perbromide) as described, for example, in U.S. Pat. No. 5,028,523 (Skoug), compounds having—$SO_2CBr_3$ groups as described for example in U.S. Pat. No. 5,594,143 (Kirk et al.) and U.S. Pat. No. 5,374,514 (Kirk et al.), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in U.S. Pat. No. 6,143,487 (Philip, Jr. et al.), diisocyanate compounds as described in EP-A-0 600 586 (Philip, Jr. et al.), and tribromomethylketones as described, for example, in EP-A-0 600 587 (Oliff et al.).

The use of "toners" or derivatives thereof that improve the image is highly desirable. Preferably, if used, a toner can be present in an amount of about 0.01% by weight to about 10%, and more preferably about 0.1% by weight to about 10% by weight, based on the total dry weight of the layer in which it is included. Toners may be incorporated in the thermographic or photothermo-graphic emulsion layer or in an adjacent layer. Toners are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.), and GB 1,439,478 (Agfa-Gevaert).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt (3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(amino-methyl)aryldicarboximides [such as (N,N-dimethylaminomethyl)phthalimide, and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethyl-pyrazole), 1,8-(3,6-diazaoctane)bis(isothiuronium)trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidine-dione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phtbalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium bexachlororhodate (III), rhodium bromide, rhodium nitrate, and potassium hexachlororhodate (III)], inorganic peroxides and persulfates (such as ammonium peroxydisulfate and hydrogen peroxide), benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-amino-pyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazine and phthalazine derivatives [such as those described in U.S. Pat. No. 6,146,822 (noted above), incorporated herein by reference] are particularly useful toners.

Binders

The photosensitive silver halide (if present), the non-photosensitive source of reducible silver ions, the non-crystalline reducing agent composition, and any other additives used in the present invention are generally used in one or more binders that are predominantly hydrophilic in nature. Mixtures of such binders can also be used. By "predominantly" is meant that at least 50% by weight of the total binders are hydrophilic in nature. The rest may include one or more binders that are hydrophobic in nature. However, the formulations for the emulsion layers are intended to be prepared and coated out of aqueous coating solvents (meaning water and mixtures of water and water-miscible solvents where water is the predominant solvent).

Useful hydrophilic binders in the various layers (especially emulsion layers) include, but are not limited to, proteins and protein derivatives, "gelatins" such as gelatin and gelatin-like derivatives (hardened or unhardened, including alkali-and acid-treated gelatins, acetylated gelatin, oxidized gelatin, phthalated gelatin, and deionized gelatin), cellulosic materials such as hydroxymethyl cellulose and cellulose esters such as cellulose acetate and cellulose acetate butyrate, polysaccharides (such as dextrin), poly (silicic acid), hydroxymethyl cellulose, acrylamide/methacrylamide polymers, acrylic/methacrylic polymers, polyvinyl pyrrolidones, polyvinyl acetates, polyvinyl alcohols, poly(vinyl lactams), polymers of sulfoalkyl acrylate and methacrylates, hydrolyzed polyvinyl acetates, and polysaccharides (such as dextrans and starch ethers) and other synthetic or naturally-occurring vehicles commonly known for use in aqueous-based photographic emulsions (see for example, *Research Disclosure*, Item 38957). Cationic starches can be used as a peptizer for tabular silver halide grains as described in U.S. Pat. No. 5,620,840 (Maskasky) and U.S. Pat. No. 5,667,955 (Maskasky). Gelatin, gelatin derivatives, and poly(vinyl alcohol) are most preferred binders.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and Pioloform BS-18 or Pioloform BL-16 (Wacker Chemical Company).

Hardeners for various binders may be present if desired. Useful hardeners are well known and include diisocyanate compounds as described for example in EP-0 600 586B1, vinyl sulfone compounds as described in U.S. Pat. No. 6,143,487 (Philip, Jr. et al), and aldehydes and various other hardeners as described in U.S. Pat. No. 6,190,822 (Dickerson et al.). The hydrophilic binders used in the photothermographic materials are generally partially or fully hardened using any conventional hardener.

Where the proportions and activities of the photothermographic materials require a particular developing time and temperature, the binder(s) should be able to withstand those conditions. Generally, it is preferred that the binder be resistant to decomposition or loss of structural integrity at 120° C. for 60 seconds. It is more preferred that it not be decomposed or lose its structural integrity at 177° C. for 60 seconds.

The binders are used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The thermographic and photothermographic materials can be prepared using a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is a particularly useful support. Various support materials are described, for example, in *Research Disclosure*, August 1979, item 18431. A method of making dimensionally stable polyester films is described in *Research Disclosure*, September, 1999, item 42536.

Opaque supports can also be used such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promo ting layers can be used. Useful subbing layer formulation s include those conventionally us ed for photographic materials such as vinylidene halide polymers.

Formulations and Construction

The formulations for the emulsion layer(s) can b e prepared by dissolving and dispersing the binder(s), the emulsion components, the reducing composition, and optional addenda in an aqueous solvent that includes water and possibly minor amounts (less than 50 volume %) of a water-miscible solvent (such as acetone or a lower alcohol) to provide aqueous-based coating formulations.

The materials of this invention can also contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads, including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP-A-0 792 476 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers, or other procedures described in the noted publication.

The thermographic and photothermographic materials of this invention can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP-A-0 678 776 (Melpolder et al.). Other antistatic agents are well known in the art.

The thermographic and photothermographic materials can be constructed of one or more layers on a support. Single layer materials should contain the photosensitive silver halide, the non-photosensitive source of reducible silver ions, the non-crystalline reducing agent composition, the hydrophilic binder, as well as optional materials such as toners, acutance dyes, coating aids, and other adjuvants.

Two-layer constructions comprising a single imaging layer coating containing all the ingredients and a protective topcoat are generally found in the thermographic or photothermographic materials. However, two-layer constructions containing photosensitive silver halide and non-photosensitive source of reducible silver ions in an emulsion layer (usually the layer adjacent to the support) and the non-crystalline reducing agent composition and other ingredients in a different layer or distributed between both layers are also envisioned. Generally, the multiple layers are coated out of water as described above. Thus, where the photothermographic materials comprise protective overcoat and/or antihalation layers, they are generally coated as aqueous formulations.

Layers to promote adhesion of one layer to another are also known, as described for example, in U.S. Pat. No. 5,891,610 (Bauer et al.), U.S. Pat. No. 804,365 (Bauer et al.), and U.S. Pat. No. 4,741,992 (Przezdziecki). Adhesion can also be promoted using specific polymeric adhesive materials as described for example, in U.S. Pat. No. 5,928,857 (Geisler et al.).

Protective overcoats or topcoats can also be present over the one or more emulsion layers. The overcoats are generally transparent are composed of one or more film-forming hydrophilic binders such as poly(vinyl alcohol), gelatin (and gelatin derivatives), and poly(silicic acid). A combination of poly(vinyl alcohol) and poly(silicic acid) is particularly useful. Such layers can further comprise matte particles, plasticizers, and other additives readily apparent to one skilled in the art.

The protective layer can also be a backing layer (such as an antihalation layer) that is on the backside of the support.

Preferred photothermographic materials of this invention comprise a protective overcoat on the imaging side, an antihalation layer on the backside, or both.

The emulsions and other formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford), all incorporated herein by reference. A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

Mottle and other surface anomalies can be reduced in the materials of this invention by incorporation of a fluorinated polymer as described for example, in U.S. Pat. No. 5,532,121 (Yonkoski et al.) or by using particular drying techniques as described, for example, in U.S. Pat. No. 5,621,983 (Ludemann et al.).

Preferably, two or more layers are applied to a film support using slide coating. The first layer can be coated on top of the second layer while the second layer is still wet.

While the first and second layers can be coated on one side of the film support, the manufacturing method can also include forming on the opposing or backside of said polymeric support, one or more additional layers, including an antihalation layer, an antistatic layer, or a layer containing a matting agent (such as silica), or a combination of such layers. It is also contemplated that the thermographic and photothermographic materials of this invention can include emulsion layers on both sides of the support.

To promote image sharpness, photothermographic materials of this invention can contain one or more layers containing acutance and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques. It is preferred that the photothermographic materials contain an antihalation coating on the support opposite to the side on which the emulsion and topcoat layers are coated.

Dyes particularly useful as antihalation and acutance dyes include dihydroperimidine squaraine dyes having the nucleus represented by the following general structure:

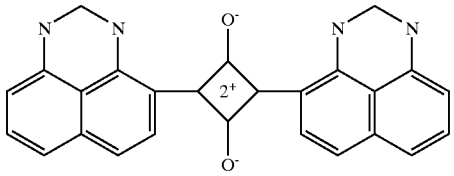

Details of such dyes having the dihydropyrimidine squaraine nucleus and methods of their preparation can be found in U.S. Pat. No. 6,063,560 (Suzuki et al.) and U.S. Pat. No. 5,380,635 (Gomez et al.), both incorporated herein by reference. These dyes can also be used as acutance dyes in frontside layers of the materials of this invention. One particularly useful dihydropyrimidine squaraine dye is cyclobutenediylium, 1,3-bis[2,3-dihydro-2,2-bis[[1-oxohexyl)oxy]methyl]-1H-pyrimidin-4-yl]-2,4-dihydroxy-, bis(inner salt).

Dyes particularly useful as antihalation dyes in a backside layer of the photothermographic material also include indolenine cyanine dyes as described in EP-A-0 342 810 (Leichter), incorporated herein by reference. One particularly useful cyanine dye, compound (6) described therein, is 3H-Indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate.

Heat-bleachable compositions can be used in backside layers as antihalation compositions. Under practical conditions of use, such compositions are heated to provide bleaching at a temperature of at least 90° C. for at least 0.5 seconds. Preferably, bleaching is carried out at a temperature of from about 100° C. to about 200° C. for from about 5 to about 20 seconds. Most preferred bleaching is carried out within 20 seconds at a temperature of from about 110° C. to about 130° C.

Useful heat-bleachable antihalation compositions can include an infrared radiation absorbing compound such as an oxonol dyes and various other compounds used in combination with a hexaarylbiimidazole (also known as a "HABI"), or mixtures thereof. Such HABI compounds are well known in the art, such as U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in copending and commonly assigned U.S. Ser. No. 09/875,772 (filed Jun. 6, 2001 by Goswami, Ramsden, Zielinski, Baird, Weinstein, Helber, and Lynch) and U.S. Ser. No. 09/944,573 (filed Aug. 31, 2001 by Ramsden and Baird).

Other antihalation compositions (such as dyes) that decolorize with heat during processing are described for example in U.S. Pat. No. 5,135,842 (Kitchin et al.), U.S. Pat. No. 5,266,452 (Kitchin et al.), U.S. Pat. No. 5,314,795 (Helland et al.), and EP-A-0 911 693 (Sakurada et al.).

Imaging/Development

While the thermographic and photothermographic materials of this invention can be imaged in any suitable manner consistent with the type of material using any suitable imaging source (typically some type of radiation or electronic signal for photothermographic materials and some type of thermal source for thermographic materials), the following discussion will be directed to the preferred imaging means for photothermographic materials. Generally, the materials are sensitive to radiation in the range of from about 190 to about 850 nm (preferably from about 400 to about 850 nm).

Imaging can be achieved by exposing the photothermographic materials to a suitable source of radiation to which they are sensitive, including ultraviolet light, visible light, near infrared radiation and infrared radiation to provide a latent image. Suitable exposure means are well known and include laser diodes that emit radiation in the desired region, photodiodes and others described in the art, including *Research Disclosure*, September 1996, item 38957, (such as sunlight, xenon lamps and fluorescent lamps). Particularly useful exposure means uses laser diodes, including laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

For using the photothermographic materials, development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example, at about 150° C. for up to 10 seconds), followed by thermal diffusion at a lower temperature (for example, at about 80° C.) in the presence of a transfer solvent.

When a thermographic material is imaged, the image may be created (and developed) merely by heating at the above noted temperatures using a thermal stylus or print head, or by heating while in contact with a heat absorbing material.

Thermographic materials of this invention may also include a dye to facilitate direct imaging and development by exposure to laser radiation. Preferably, the dye is an infrared absorbing dye and the laser is a diode laser emitting in the infrared region of the electromagnetic spectrum. Upon exposure to radiation, the dye converts radiation to heat to develop an image.

Methods and Materials for the Examples:

All materials used in the following examples are readily available from standard commercial sources or prepared using known procedures and starting materials unless otherwise specified. All percentages are by weight unless otherwise indicated.

Infrared Spectral Sensitizing IR Dye 1 is

IR-1

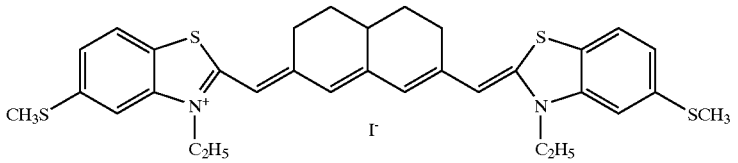

Antifoggant AF-1 is 2,2'-dibromo-(4-methylphenyl)sulfonyl-N-(2-sulfoethyl)acetamide, potassium salt, and has the following structure:

AF-1

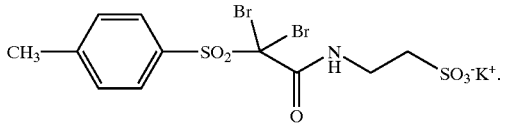

Antifoggant AF-1 can be prepared as follows:

To a 5-liter flask equipped with a mechanical stirrer and reflux condenser was addedp-toluenesulfinic acid, lithium salt (308.57 g), N-(2-sulfoethyl)-2-bromoacetamide, lithium salt (527.39 g), water (180 ml), and ethyl alcohol (3380 ml). The resulting suspension was heated to reflux. After about an hour of reflux, nearly all of the reactants had dissolved. Reflux was continued another four hours, and the solution was filtered hot through a Celite pad to remove some haziness. The solution was cooled overnight to room temperature. The solid that formed was collected and washed with 1 liter of 95% ethyl alcohol/water. The white solid was air dried and then dried at high vacuum, providing 553.88 g (89% yield) of 2-(4-methylphenyl)sulfonyl-N-(2-sulfoethyl)acetamide, lithium salt (Intermediate 1). HPLC analysis showed no detectable impurities. Ion chromatography indicated 0.035 weight % bromide and 1.8 weight % lithium. The material exhibited an acceptable proton spectrum.

To glacial acetic acid (660 ml) was added Intermediate 1 (98.19 g), and 1,3-dibromo-5,5-dimethylhydantoin (42.89 g). The resulting suspension was heated to reflux where solution occurred. After about 3–5 minutes at reflux, the-slight bromine color was discharged, and reflux was continued to another 15 minutes. Analysis of the reaction mixture by HPLC indicated conversion to one main product. After cooling to near room temperature, most of the acetic acid was removed on the rotary film evaporator using a water aspirator (water bath temperature at 40° C.). The residue was diluted with 2500 ml of ethyl alcohol. Complete solution occurred after stirring the suspension for one hour at room temperature. To this stirring solution at room temperature was added dropwise a solution of potassium acetate (58.88 g) dissolved in ethyl alcohol (500 ml). A white solid formed immediately. Upon complete addition of the potassium acetate solution, the suspension was stirred at room temperature for 90 minutes, and the desired antifoggant AF-1, 2,2-dibromo-2-(4-methylphenyl)sulfonyl-N-(2-sulfoethyl)acetamide, potassium salt, was collected by filtration and washed with ethyl alcohol. The solid was then dried under high vacuum at 40° C. The yield of crude antifoggant AF-1, which had a slight odor of acetic acid, was 145.22 g (94%).

Two separate synthetic batches of AF-1 were made, combined, and recrystallized by dissolving 182.33 g of product in a mixture of water (85 ml) and ethyl alcohol (600 ml) while boiled, filtered hot, and adding about 7 ml water upon cooling to prevent oiling. After letting the solution stand overnight at room temperature, the desired antifoggant product was collected and washed with about 300 ml (10:1 v/v) ethyl alcohol/water mixture. The product was then air-dried and then dried under high vacuum at 40° C., providing 159.87 g of desired product. HPLC analysis indicated an assay of 99.2% of the desired component. The product exhibited the expected proton NMR spectrum and mass spectrum consistent with the AF-1 structure shown above.

Antifoggant AF-2 is 2-bromo-2-(4-methylphenylsulfonyl)acetamide, can be obtained using the teaching provided in U.S. Pat. No. 3,955,982 (Van Allan), and has the following structure:

AF-2

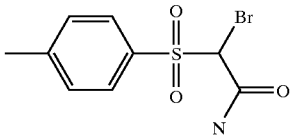

Reducing agent (developer) DEV-1 is 2,2'-(2-methylpropylidene)bis(4,6-dimethyl-phenol) and has the following structure:

DEV-1

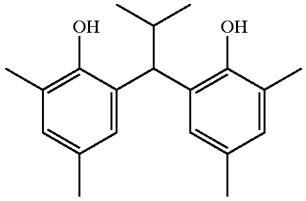

Reducing agent (developer) DEV-2 is 2,2'-(3,5,5-trimethylhexylidene)bis(4,6-dimethyl-phenol) and has the following structure:

DEV-2

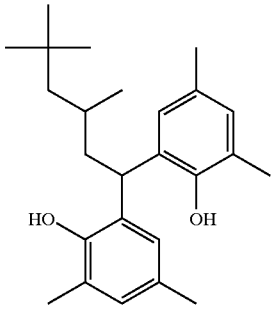

The following examples are representative of the present invention and its practice and are not meant to be limiting in any manner.

EXAMPLE 1

A) Preparation of Nanoparticulate Silver Behenate

A reactor was initially charged with demineralized water, a 10% solution of dodecylthiopolyacrylamide surfactant (72 g), and behenic acid [46.6 g, nominally 90% behenic acid (Unichema) recrystallized from isopropanol]. The reactor contents were stirred at 150 rpm and heated to 70° C. at which time a 10.85% w/w KOH solution (65.1 g) were added to the reactor. The reactor contents were then heated to 80° C. and held for 30 minutes until a hazy solution was achieved. The reaction mixture was then cooled to 70° C. and a silver nitrate solution consisting of silver nitrate (166.7 g of 12.77% solution) was added to the reactor at a controlled rate during 30 min. The reactor contents were then held at the reaction temperature for 30 minutes, cooled to room temperature, and decanted. A nanoparticulate silver behenate dispersion (NPSBD) with a median particle size of 140 nm was obtained (3% solids).

B) Purifying and Concentrating NPSBD

The 3% solids nanoparticulate silver behenate dispersion (12 kg) was loaded into a diafiltration/ultrafiltration apparatus (with an Osmonics model 21-HZ20-S8J permeator membrane cartridge having an effective surface area of 0.34 $m^2$ and a nominal molecular weight cutoff of 50,000). The apparatus was operated so that the pressure going into the permeator was 50 $lb/in^2$ (3.5 $kg/cm^2$) and the pressure downstream from the permeator was 20 $lb/in^2$ (1.4 $kg/cm^2$). The permeate was replaced with deionized water until 24 kg of permeate were removed from the dispersion. At this point the replacement water was turned off and the apparatus was run until the dispersion reached a concentration of 28% solids to provide a nanoparticulate silver behenate dispersion (NPSB).

C) AgBrI Imaging Emulsion

A silver bromoiodide emulsion was prepared using conventional precipitation techniques. The resulting AgBrI emulsion comprised 3 mol % iodide (based on total silver in the silver halide) cubic grains having a mean edge length of 57 nm, and gelatin (20 g/mol silver in the silver halide).

D) Preparation of Comparative Example 1 Photothermographic Material

An imaging composition to yield 0.1 kg of liquid mixture was prepared by mixing at 40° C. an aqueous solution of deionized bone gelatin (10.2 g of 35%), water (47.4 g), and the NPSBD (28.9 g) and adjusting to pH 6.5. An aqueous solution (1.4 g) of sodium iodide (50 g/l) was added to the stirring mixture and held for 60 minutes, then the mixture was held at 30° C. for an additional 60 minutes. To this mixture was then added the AgBrI emulsion (1.7 g) with further holding for 30 minutes. Next were added Antifoggant AF-1 (0.6 g of 2.5% aqueous solution), Antifoggant AF-2 (1.1 g of 20.3% by weight solid-particle dispersion prepared using conventional milling techniques), 4-methylphthalic acid (0.9 g of 10% aqueous solution) and succinimide (0.6 g). An hour later, solid-particle dispersions of reducing agent DEV-1(3.4 g of 15% by weight) and reducing agent DEV-2 (4.5 g of 20% by weight) that had been prepared using conventional milling techniques were added. The reducing agents in the formulations were crystalline materials as determined by polarized light optical microscopy.

This formulation was coated onto a clear, gelatin-subbed, 0.178-mm thick poly(ethylene terephthalate) support to give a wet coverage of 135 g/m$^2$ to provide a Control photothermographic material outside the scope of the present invention.

E) Preparation of Evaporated Dispersion of Bisphenol Developer Mixture (ED)

An oil phase consisting of DEV-1 (10.0 g), DEV-2 (10 g), and ethyl acetate (50 g) was heated to 50° C. to dissolve the reducing agents. This was combined with an aqueous solution of Type IV deionized bone gelatin (12.0 g), a 10.0% solution (12.0 g) of Alkanol XC (Dupont), and distilled water (106.0 g). This mixture was passed through a Gaulin colloid mill five times followed by removal of the ethyl acetate by rotary evaporation. Distilled water was added to replace the lost ethyl acetate to yield 200.0 g of a 10.0% developer, 6.0% gelatin dispersion. The reducing agents in the resulting reducing agent composition were no longer crystalline in nature as determined by polarized light optical microscopy.

Preparation of Inventive Photothermographic Material

The process used to prepare the photothermographic material of Comparative Example 1 was repeated here except that Bisphenol Developer Dispersion ED was used to provide the reducing agents in non-crystalline form. The total amounts of reducing agents DEV-1 and DEV-2 in the aqueous coating formulation were identical to those in Comparative Example 1.

This formulation was coated onto a clear, gelatin-subbed, 0.178-mm thick poly(ethylene terephthalate) support to give a wet coverage of 135 g/m$^2$ to provide a photothermographic material of the present invention.

Both Control and Inventive photothermographic materials identified above were exposed with a xenon light source for 0.001 second using a conventional Mark VI EG&G sensitometer and heat processed at 122° C. for 15 seconds on a moving drum to provide a silver image in each material. The transmission density of the developed silver was measured with a conventional X-rite model 310 photographic densitometer. Larger density values are desirable and indicate greater developability.

The results of the following TABLE I demonstrate that non-crystalline mixtures of bisphenol reducing agents provided in an evaporated dispersion provide greater development activity than crystalline mixtures of the same reducing agents that are milled and provided as solid particle dispersions.

TABLE I

| Material | Developer Dispersion Technique | Density |
|---|---|---|
| Control | Milled-solid particle | 1.76 |
| Example 1 | Evaporated | 2.37 |

The invention has been described in detail with particular reference to certain preferred embodiments thereof, but it will be understood that variations and modifications can be effected within the spirit and scope of the invention.

We clam:

1. A thermally sensitive emulsion comprising:

a) a non-photosensitive source of reducible silver ions, b) a hydrophilic binder, and c) a non-crystalline reducing agent composition for said reducible silver ions, which non-crystalline reducing agent composition includes two or more hindered phenol silver ion reducing agents.

2. The emulsion of claim 1 wherein said non-crystalline reducing agent composition is provided as an evaporated dispersion.

3. The emulsion of claim 1 that is prepared by:

A) dissolving said two or more crystalline hindered phenol silver ion reducing agents in one or more low boiling organic solvents to form a solvent solution, with or without one or more permanent high boiling organic solvents, B) combining said solvent solution with said hydrophilic binder and a surfactant in an aqueous phase to form a two-phase mixture, C) emulsifying said two-phase mixture, D) removing said one or more low boiling organic solvents from said two-phase mixture to provide a non-crystalline reducing agent composition, and E) combining said non-crystalline reducing agent composition with a non-photosensitive source of reducible silver ions.

4. The emulsion of claim 1 wherein said hindered phenol silver ion reducing agents are bisphenols.

5. The emulsion of claim 3 comprising a mixture of 2,2'-(2-methylpropylidene)bis(4,6-dimethyl-phenol) (DEV-1) and 2,2'-(3,5,5-trimethyldexylidene)bis(4,6-dimethyl-phenol) (DEV-2).

6. The emulsion of claim 1 wherein said hydrophilic binder is polyvinyl alcohol, gelatin, a gelatin derivative, or a hydroxy-substituted cellulosic material, and said surfactant is an anionic surfactant.

7. The emulsion of claim 1 that is a photothermographic emulsion and further comprises a photosensitive silver halide.

8. The emulsion of claim 7 further comprising a toner, an antifoggant, or a spectral sensitizing dye.

9. The emulsion of claim 1 wherein said non-photosensitive source of reducible silver ions includes one or more silver carboxylates, one of which is silver behenate.

10. A thermally developable material comprising a support having thereon at least one imaging layer comprising a hydrophilic binder, and having in reactive association:

a) a non-photosensitive source of reducible silver ions, and b) a non-crystalline reducing agent composition for said reducible silver ions, which non-crystalline reducing agent composition includes two or more hindered phenol silver ion reducing agents.

11. The thermally developable material of claim 10 wherein said non-crystalline reducing agent composition is provided as an evaporated dispersion.

12. The thermally developable material of claim 10 wherein said non-photosensitive source of reducible silver ions includes one or more silver salts provided in an aqueous nanoparticulate dispersion.

13. The thermally developable material of claim 10 wherein said non-photosensitive source of reducible silver ions is a silver carboxylate of a long chain fatty acid having 8 to 30 carbon atoms in the fatty acid chain, or a mixture of such silver carboxylates, at least one of which is silver behenate.

14. The thermally developable material of claim 10 wherein said hindered phenol reducing agents are bisphenol reducing agents.

15. A photothermographic material comprising a support having thereon at least one imaging layer comprising a hydrophilic binder, and having in reactive association:

a) a photosensitive silver halide, b) a non-photosensitive source of reducible silver ions, and c) a non-crystalline reducing agent composition for said reducible silver ions, which non-crystalline reducing agent composition includes two or more hindered phenol silver ion reducing agents.

16. The photothermographic material of claim 15 wherein said non-crystalline reducing agent composition is provided as an evaporated dispersion.

17. The photothermographic material of claim 15 wherein said non-photosensitive source of reducible silver ions includes one or more silver salts provided in an aqueous nanoparticulate dispersion.

18. The photothermographic material of claim 15 wherein said non-photosensitive source of reducible silver ions is a silver carboxylate of a long chain fatty acid having 8 to 30 carbon atoms in the fatty acid chain, or a mixture of such silver carboxylates, at least one of which is silver behenate.

19. The photothermographic material of claim 15 wherein said hindered phenol reducing agents are bisphenol reducing agents.

20. The photothermographic material of claim 15 further comprising an antifoggant that has a pKa of 8 or less and is represented by the following Structure I:

$$R_1—SO_2—C(R_2)R_3—(CO)_m—(L)_n—SG$$

wherein $R_1$ is an aliphatic or cyclic group, $R_2$ and $R_3$ are independently hydrogen or bromine as long as at least one of them is bromine, L is an aliphatic divalent linking group, m and n are independently 0 or 1, and SG is a solubilizing group having a pKa of 8 or less.

21. The photothermographic material of claim 15 that is sensitive to radiation of from about 600 to about 1150 nm.

22. The photothermographic material of claim 15 wherein said hydrophilic binder is polyvinyl alcohol, gelatin, a gelatin derivative, or a hydroxy-substituted cellulosic material.

23. The photothermographic material of claim 15 further comprising a surface protective overcoat on the imaging side of said support, an antihalation layer on the backside of said support, or both.

24. The photothermographic material of claim 15 wherein said hydrophilic binder and components a), b), and c) are provided in a single photothermographic emulsion.

25. The photothermographic material of claim 24 wherein said photothermographic emulsion is prepared by:

A) dissolving said two or more crystalline hindered phenol silver ion reducing agents in one or more low boiling organic solvents to form a solvent solution, with or without a permanent high boiling organic solvent, B) combining said solvent solution with said hydrophilic binder and an anionic surfactant in an aqueous phase to form a two-phase mixture, C) emulsifying said two-phase mixture, D) removing said one or more low boiling organic solvents from said two-phase mixture to provide a non-crystalline reducing agent composition, and E) combining said non-crystalline reducing agent composition with a photosensitive silver halide and a non-photosensitive source of reducible silver ions.

26. A photothermographic material comprising a transparent support having thereon an aqueous-based imaging layer comprising gelatin or a gelatin derivative as binder, and having in reactive association:

a) photosensitive silver bromide, silver iodobromide, or both, b) a non-photosensitive source of reducible silver ions that comprises one or more silver carboxylates provided as an aqueous nanoparticulate dispersion, at least one of which silver carboxylates is silver behenate, c) a non-crystalline reducing agent composition for said reducible silver ions that includes a mixture of 2,2'(2-methylpropylidene)bis(4,6-dimethyl-phenol) (DEV-1) and 2,2'-(3,5,5-trimethylhexylidene)bis(4,6-dimethyl-phenol) (DEV-2), which mixture is provided as an evaporated dispersion, and d) one or more antifoggants, toners, or spectral sensitizing dyes, said photothermographic material further comprising an aqueous-based surface protective overcoat over said imaging layer, and an aqueous-based antihalation layer on the backside of said support.

27. A method of making a photothermographic emulsion comprising the steps of:

A) dissolving two or more crystalline hindered phenol silver ion reducing agents in one or more low boiling organic solvents to form a solvent solution, with or without one or more permanent high boiling organic solvents, B) combining said solvent solution with a hydrophilic binder and a surfactant to form a two-phase mixture, C) emulsifying said two-phase mixture, D) removing said one or more low boiling organic solvents to provide a non-crystalline reducing agent composition, and E) combining said non-crystalline reducing agent composition with a photosensitive silver halide and a non-photosensitive source of reducible silver ions.

28. The method of claim 27 wherein said one or more low boiling organic solvents includes ethyl acetate, said surfactant is an anionic surfactant, and said two or more hindered phenol silver ion reducing agents includes 2,2'(2-methylpropylidene)bis(4,6-dimethyl-phenol) (DEV-1) and 2,2'-(3,5,5-trimethylhexylidene)bis(4,6-dimethyl-phenol) (DEV-2).

29. A method of forming a visible image comprising:

A) imagewise exposing the photothermographic material of claim 15 to electromagnetic radiation at a wavelength greater than 400 nm to form a latent image, B) simultaneously or sequentially, heating said exposed photothermo-graphic material to develop said latent image into a visible image.

30. The method of claim 29 wherein said photothermographic material comprises a transparent support, and said image-forming method further comprising:

C) positioning said exposed and heat-developed photothermographic material having said visible image therein between a source of imaging radiation and an imageable material that is sensitive to said imaging radiation, and D) thereafter exposing said imageable material to said imaging radiation through the visible image in said exposed and heat-developed photo-thermographic material to provide a visible image in said imageable material.

31. A method of forming a visible image comprising imagewise heating the thermally developable material of claim 10 to provide a visible image.

* * * * *